US008246453B2

(12) United States Patent
St. John et al.

(10) Patent No.: US 8,246,453 B2
(45) Date of Patent: Aug. 21, 2012

(54) WAGERING GAME DEVICE HAVING UBIQUITOUS CHARACTER SET

(75) Inventors: Daniel Norman St. John, Crystal Lake, IL (US); Mark J. Saletnik, Mount Prospect, IL (US); Vikram Swamy, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 662 days.

(21) Appl. No.: 11/919,480

(22) PCT Filed: Apr. 28, 2006

(86) PCT No.: PCT/US2006/016222

§ 371 (c)(1),
(2), (4) Date: Nov. 2, 2009

(87) PCT Pub. No.: WO2006/116676

PCT Pub. Date: Nov. 2, 2006

(65) Prior Publication Data

US 2010/0041467 A1 Feb. 18, 2010

Related U.S. Application Data

(60) Provisional application No. 60/675,610, filed on Apr. 28, 2005.

(51) Int. Cl.
*A63F 9/24* (2006.01)

(52) U.S. Cl. ..... 463/30; 709/206

(58) Field of Classification Search ..... 463/20–42
See application file for complete search history.

(56) References Cited

U.S. PATENT DOCUMENTS

| | | | | |
|---|---|---|---|---|
| 6,119,127 | A | 9/2000 | Pytlovany | |
| 6,293,802 | B1 * | 9/2001 | Ahlgren | 434/252 |
| 6,690,992 | B1 | 2/2004 | Pytlovany | |
| 7,188,186 | B1 | 3/2007 | Meyer et al. | |
| 2001/0044339 | A1 | 11/2001 | Cordero et al. | |
| 2002/0137565 | A1 | 9/2002 | Blanco | |
| 2003/0134675 | A1 | 7/2003 | Oberberger | |
| 2004/0127284 | A1 | 7/2004 | Walker et al. | |
| 2004/0166931 | A1 * | 8/2004 | Criss-Puszkiewicz et al. | 463/29 |
| 2004/0167768 | A1 | 8/2004 | Travieso et al. | |

(Continued)

FOREIGN PATENT DOCUMENTS

WO WO-9942936 A1 8/1999

(Continued)

OTHER PUBLICATIONS

"International Search Report for Application No. PCT/US2006/016222, date mailed Sep. 29, 2006", 4 pgs.

(Continued)

*Primary Examiner* — Masud Ahmed
(74) *Attorney, Agent, or Firm* — Schwegman, Lundberg & Woessner, P.A.

(57) ABSTRACT

A wagering game machine uses a single character set for displaying text in multiple languages. The character set may also be used for printing materials, such as ticket printing. In one embodiment, the character set comprises Unicode standard characters, where each character in the font is represented by a unique number, which maps to the Unicode standard, regardless of platform. This allows programs that conform to the Unicode standard to deal with text in multiple languages.

20 Claims, 6 Drawing Sheets

U.S. PATENT DOCUMENTS

| | | | | |
|---|---|---|---|---|
| 2004/0222970 | A1 | 11/2004 | Martinez et al. | |
| 2004/0224765 | A1 | 11/2004 | Martinez et al. | |
| 2004/0242324 | A9 * | 12/2004 | Walker et al. | 463/40 |
| 2005/0005266 | A1 * | 1/2005 | Datig | 717/136 |
| 2006/0068911 | A1 | 3/2006 | Pirich et al. | |
| 2006/0160602 | A1 | 7/2006 | Blythe et al. | |
| 2006/0205482 | A1 * | 9/2006 | Crivelli | 463/25 |
| 2006/0229163 | A1 | 10/2006 | Waters | |

FOREIGN PATENT DOCUMENTS

| | | | |
|---|---|---|---|
| WO | WO-0119072 | A1 | 3/2001 |
| WO | WO-0242921 | A1 | 5/2002 |
| WO | WO-03092839 | A2 | 11/2003 |
| WO | WO-2004012059 | A2 | 2/2004 |
| WO | WO-2004046885 | A2 | 6/2004 |
| WO | WO-2005111828 | A2 | 11/2004 |
| WO | WO-2005076190 | A1 | 8/2005 |
| WO | WO-2005110750 | A2 | 11/2005 |
| WO | WO-2005111778 | A2 | 11/2005 |
| WO | WO-2005111829 | A1 | 11/2005 |
| WO | WO-2005111830 | A1 | 11/2005 |
| WO | WO-2005111847 | A1 | 11/2005 |
| WO | WO-2005111848 | A1 | 11/2005 |
| WO | WO-2006116676 | A2 | 11/2006 |
| WO | WO-2007099558 | A2 | 9/2007 |

OTHER PUBLICATIONS

"Written Opinion of the International Searching Authority for Application No. PCT/US2006/016222, date mailed Sep. 29, 2006", 7 pgs.

* cited by examiner

350

| | 370 | 375 | 380 | |
|---|---|---|---|---|
| 355 RESOURCE KEY | ENGLISH CHARACTERS | FRENCH CHARACTERS | JAPANESE CHARACTERS | • • • |
| 360 MESSAGE 1 | ABC | - - - | - - - | • • • |
| 365 MESSAGE 2 | DEF | - - - | - - - | • • • |
| ⋮ | ⋮ | ⋮ | ⋮ | ⋮ |

WAGERING GAME DEVICE HAVING UBIQUITOUS CHARACTER SET

RELATED APPLICATION

This application is a U.S. National Stage Filing under 35 U.S.C. 371 from International Patent Application Serial No. PCT/US2006/016222, filed Apr. 28, 2006, and published on Nov. 2, 2006 as WO 2006/0116676 A2, which claims the priority benefit of U.S. Provisional Application Ser. No. 60/675,610 filed Apr. 28, 2005, the contents of which are incorporated herein by reference.

COPYRIGHT

A portion of the disclosure of this patent document contains material to which the claim of copyright protection is made. The copyright owner has no objection to the facsimile reproduction by any person of the patent document or the patent disclosure, as it appears in the Patent and Trademark Office file or records, but reserves all other rights whatsoever. Copyright 2006, WMS Gaming, Inc.

FIELD

The present invention relates to wagering game devices, and in particular to a wagering game device having a ubiquitous character set.

BACKGROUND

Wagering game machines are used throughout the world. Prior wagering game machines contained text residing in software programming. The text was encoded as ASCII characters in most machines, such as a single byte. Use of a single byte limited the number of characters available for display or printing of text. Some languages have more characters than can be represented by a single byte. In addition, wagering game machines implementing a different language were separately programmed. Many languages also contain characters that are not contained within the ASCII character set. Each different language resulted in different software, and required significant testing and potential regulatory processes for approval. Ticket printing also required different characters for representing different currencies, increasing the complexity of providing wagering game machines for different jurisdictions and player preferences.

DETAILED DESCRIPTION

In the following description, reference is made to the accompanying drawings that form a part hereof, and in which is shown by way of illustration specific embodiments, which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

The functions or algorithms described herein are implemented in software or a combination of software and human implemented procedures in one embodiment. The software comprises computer executable instructions stored on computer readable media such as flash memory or other type of storage devices. The term "computer readable media" is also used to represent various forms of electromagnetic energy which may be used to transmit information. The media may be on another server, which may be used for download of game content containing Unicode. Further, such functions correspond to modules, which are software, hardware, firmware or any combination thereof. Multiple functions are performed in one or more modules as desired, and the embodiments described are merely examples. The software is executed on a digital signal processor, ASIC, microprocessor, or other type of processor operating on a computer system, such as a personal computer, server or other computer system.

As used herein, the term casino game or wagering game device encompasses, without limitation, slot machines, video poker machines, roulette tables, poker tables, craps tables and any other game of chance offered by a wagering game establishment wherein for example the game qualifies as regulated and/or licensed wagering game equipment.

A wagering game machine uses a single character set for displaying text in multiple languages. The character set may also be used for printing or displaying text materials, such as ticket printing. In one embodiment, the character set comprises Unicode standard characters, where each character in the font is represented by a unique number mapped to the Unicode standard.

In one embodiment, an operator has the ability to enable/disable languages on a game, and to have tickets printed in a language and currency formatting specific to their country/language, making them easier to use and understand.

Figure 1A:
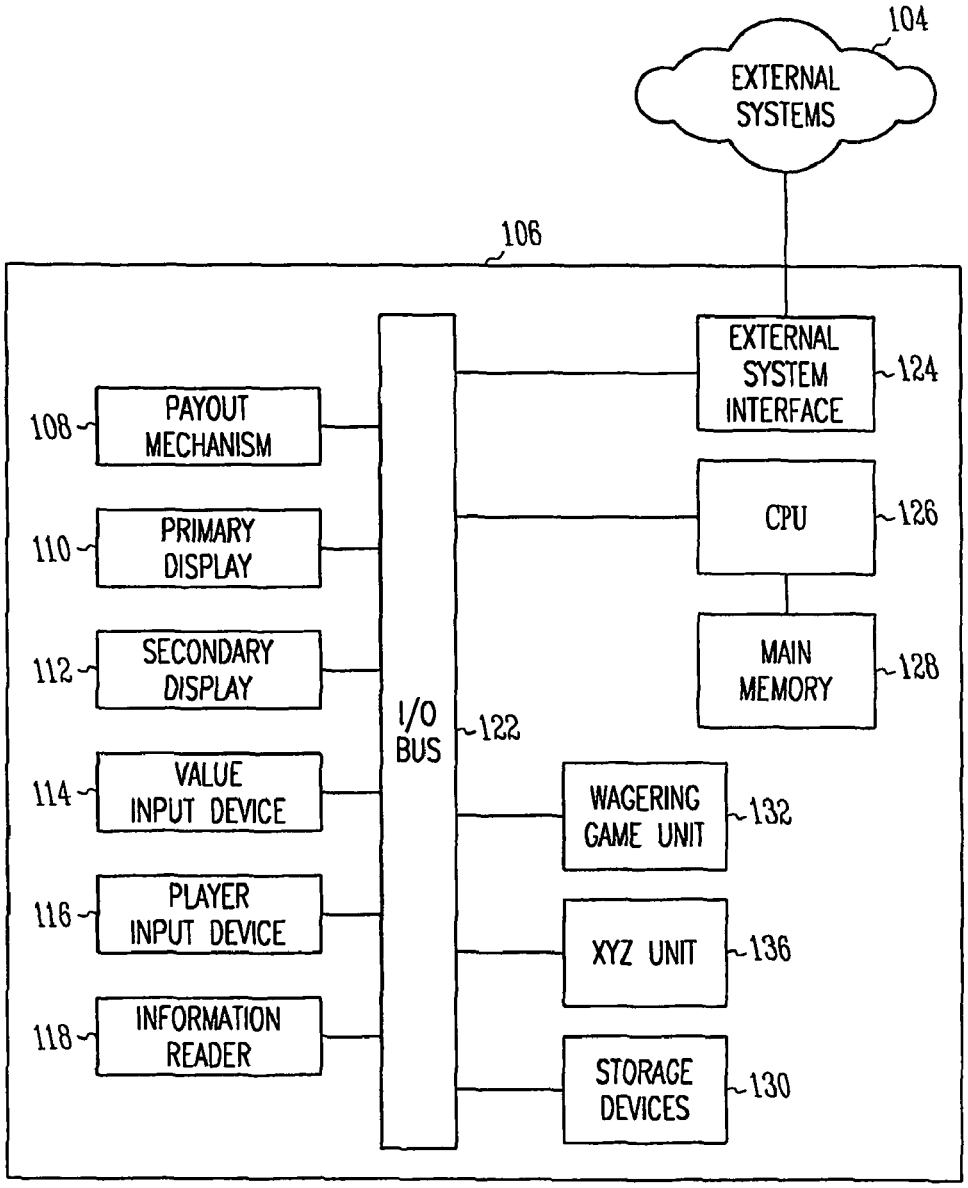
FIG. 1A is a block diagram of a control system suitable for operating the wagering game machine.

FIG. 1A is a block diagram illustrating a wagering game machine, according to example embodiments of the invention. As shown in FIG. 1A, the wagering game machine 106 includes a central processing unit (CPU) 126 connected to main memory 128. The CPU 126 is also connected to an input/output (I/O) bus 122, which facilitates communication between the wagering game machine's components. In one embodiment, the CPU 126 can process wagers and conduct wagering games, such as video poker, video black jack, video slots, video lottery, etc., in whole or in part.

The I/O bus 122 is connected to a payout mechanism 108, primary display 110, secondary display 112, value input device 114, player input device 116, information reader 118, and storage unit 130. The player input device 116 may include the value input device 114 to the extent the player input device 116 is used to place wagers. The I/O bus 122 is also connected to an external system interface 124, which is connected to external systems 104 (e.g., wagering game networks).

In one embodiment, the wagering game machine 106 can include additional peripheral devices and/or more than one of each component shown in FIG. 1A. For example, in one embodiment, the wagering game machine 106 can include external system interfaces 124 and multiple CPUs 126. In one embodiment, any of the components can be integrated or subdivided. Additionally, in one embodiment, the components of the wagering game machine 106 can be interconnected according to any suitable interconnection architecture (e.g., directly connected, hypercube, etc.).

In one embodiment, any of the components of the wagering game machine 106 can include hardware, firmware, and/or software for performing the operations described herein. Furthermore, any of the components can include machine-readable media including instructions for causing a machine to perform the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 1B:
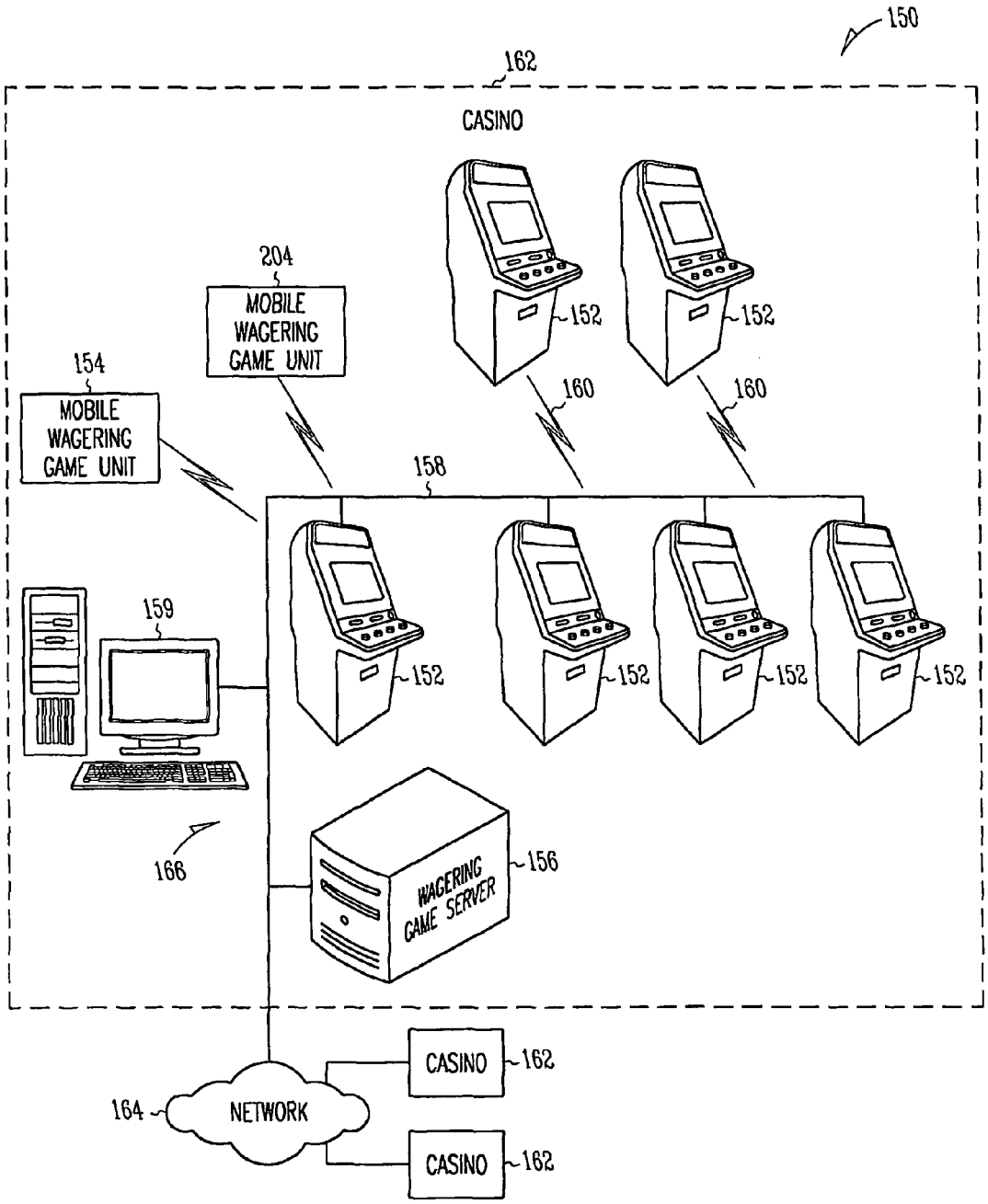
FIG. 1B is a block diagram of networked wagering game machines according to an example embodiment.

While FIG. 1A describes example embodiments of a wagering game machine, FIG. 1B shows how a plurality of wagering game machines can be connected in a wagering game network.

Figure 2:
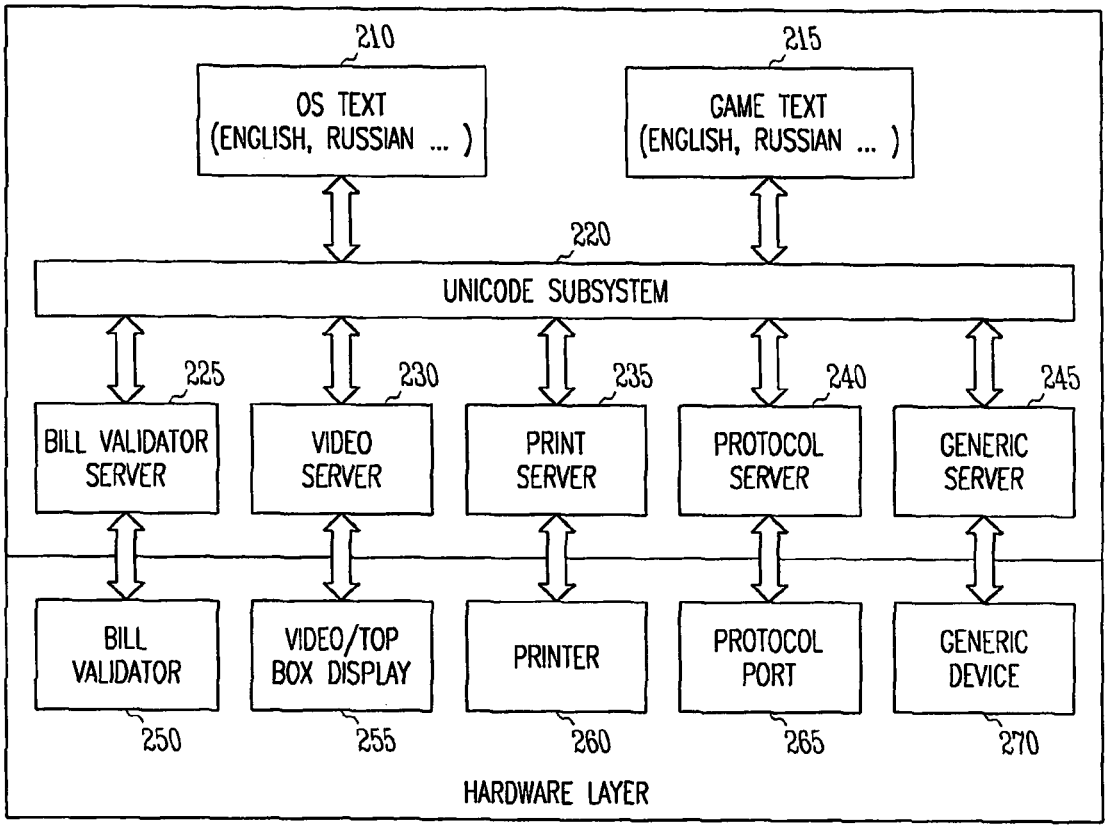
FIG. 2 is a block diagram illustrating text rendering in the wagering game machine of FIG. 1 according to an example embodiment.

FIG. 1B is a block diagram illustrating a wagering game network, according to example embodiments of the invention. As shown in FIG. 2, the wagering game network 150 includes a plurality of casinos 162 connected to a communications network 164.

Each of the plurality of casinos 162 includes a local area network 166 in which wagering game machines 152 are connected to a wagering game server 156 that may serve wagering games over the network. The wagering game machines 152 and wagering game server 156 can include hardware and/or machine-readable media including instructions for performing functions as described herein. A remote configuration server 159 may also be provided to allow for remote configuration of wagering game machines 152 by an administrator or operator. Such wagering game machines may also be configured directly by the administrator or operator.

The wagering game machines 152 described herein can take any suitable form, such as floor standing models, handheld mobile units, bartop models, workstation-type console models, etc. Further, the machines 152 may be primarily dedicated for use in conducting wagering games, or may be a non-dedicated device such as a mobile phone, personal digital assistant, personal computer, etc. In one embodiment, the wagering game network 150 can include other network devices, such as accounting servers, wide area progressive servers, player tracking servers, and/or other devices suitable for use in connection with embodiments of the invention.

The components of each casino 162 can communicate over wired 158 and/or wireless connections 160. Furthermore, they can employ any suitable connection technology, such as Bluetooth, 802.11, Ethernet, public switched telephone networks, SONET, etc.

Figure 1C:
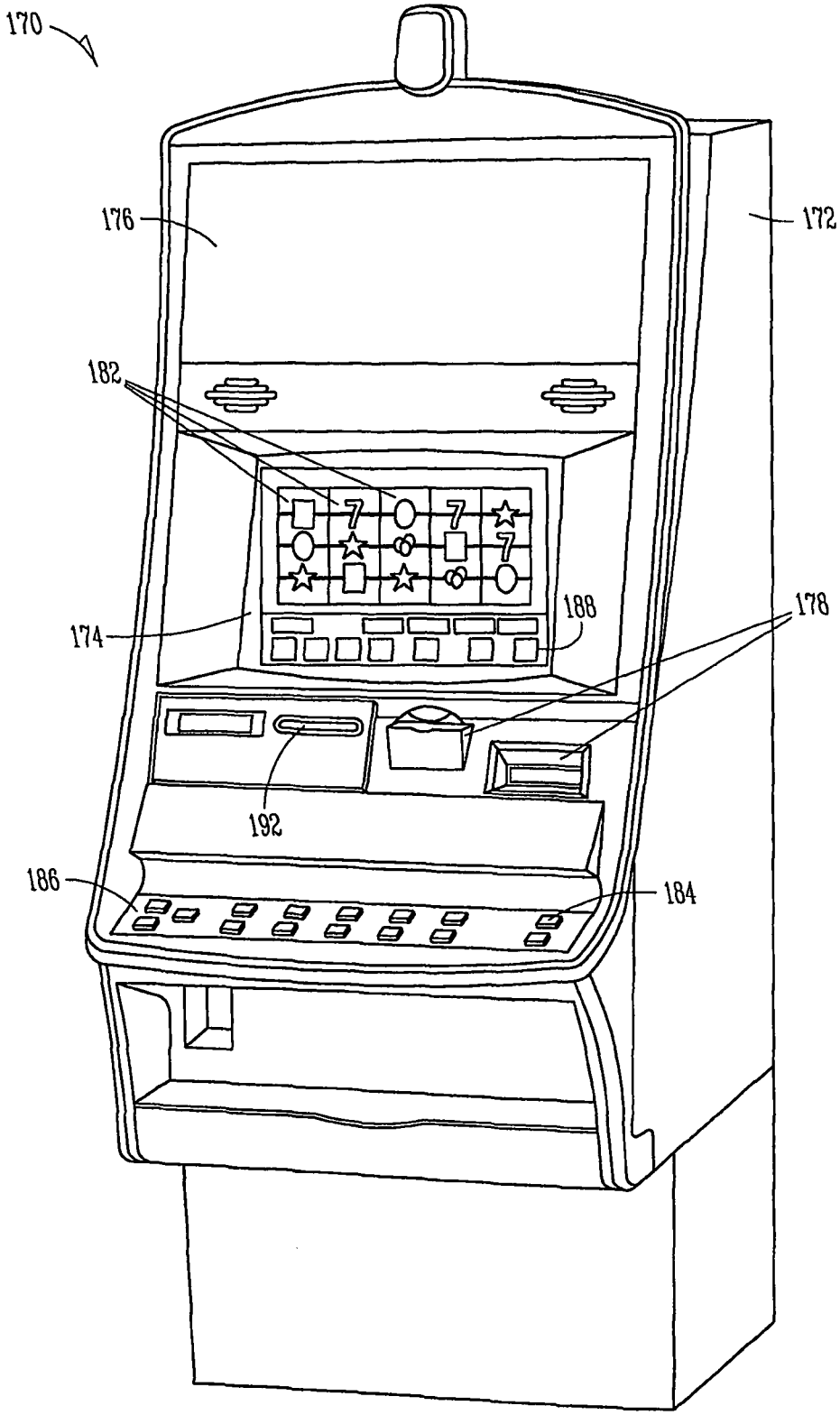
FIG. 1C is a perspective view of a wagering game machine, according to example embodiments of the invention.

FIG. 1C is a perspective view of a wagering game machine, according to example embodiments of the invention. Referring to FIG. 1C, a wagering game machine 170 is used in gaming establishments, such as casinos. According to embodiments, the wagering game machine 170 can be any type of wagering game machine and can have varying structures and methods of operation. For example, the wagering game machine 170 can be an electromechanical wagering game machine configured to play mechanical slots, or it can be an electronic wagering game machine configured to play video casino games, such as blackjack, slots, keno, poker, blackjack, roulette, etc.

The wagering game machine 170 comprises a housing 172 and includes input devices, including value input devices 178 and a player input device 184. For output, the wagering game machine 170 includes a primary display 174 for displaying information about a basic wagering game. The primary display 314 can also display information about a bonus wagering game and a progressive wagering game. The wagering game machine 170 also includes a secondary display 176 for displaying wagering game events, wagering game outcomes, and/or signage information. While some components of the wagering game machine 170 are described herein, numerous other elements can exist and can be used in any number or combination to create varying forms of the wagering game machine 170.

The value input devices 178 can take any suitable form and can be located on the front of the housing 172. The value input devices 178 can receive currency and/or credits inserted by a player. The value input devices 178 can include coin acceptors for receiving coin currency and bill acceptors for receiving paper currency. Furthermore, the value input devices 178 can include ticket readers or barcode scanners for reading information stored on vouchers, cards, or other tangible portable storage devices. The vouchers or cards can authorize access to central accounts, which can transfer money to the wagering game machine 170.

The player input device 184 comprises a plurality of push buttons on a button panel 186 for operating the wagering game machine 170. In addition, or alternatively, the player input device 184 can comprise a touch screen 188 mounted over the primary display 174 and/or secondary display 176.

The various components of the wagering game machine 170 can be connected directly to, or contained within, the housing 172. Alternatively, some of the wagering game machine's components can be located outside of the housing 172, while being communicatively coupled with the wagering game machine 170 using any suitable wired or wireless communication technology.

The operation of the basic wagering game can be displayed to the player on the primary display 174. The primary display 174 can also display a bonus game associated with the basic wagering game. The primary display 174 can include a cathode ray tube (CRT), a high resolution liquid crystal display (LCD), a plasma display, light emitting diodes (LEDs), or any other type of display suitable for use in the wagering game machine 170. Alternatively, the primary display 174 can include a number of electromechanical reels to display the outcome. In FIG. 1C, the wagering game machine 170 is an "upright" version in which the primary display 174 is oriented vertically relative to the player. Alternatively, the wagering game machine can be a "slant-top" version in which the primary display 174 is slanted at about a thirty-degree angle toward the player of the wagering game machine 170. In yet another embodiment, the wagering game machine 170 can be a bartop model, handheld mobile unit, or workstation-type console model, etc.

A player begins playing a basic wagering game by placing a wager via the player input device 176 and/or value input device 178. The player can initiate play by using the push buttons or touch screen of the player input device 176. The basic game can include arranging a plurality of symbols along a payline 182, which indicates one or more outcomes of the basic game. Such outcomes can be randomly selected in response to player input. At least one of the outcomes, which can include any variation or combination of symbols, can trigger a bonus game.

In some embodiments, the wagering game machine 170 can also include an information reader 192, which can include a card reader, ticket reader, bar code scanner, RFID transceiver, or computer readable storage medium interface. In some embodiments, the information reader 192 can be used to award complimentary services, restore game assets, track player habits, etc.

Example Operations

This section describes operations performed by embodiments of the invention. In the discussion below, the flow diagrams will be described with reference to the block diagrams presented above. In certain embodiments, the operations are performed by instructions residing on machine-readable media (e.g., software), while in other embodiments, the operations are performed by hardware and/or other logic (e.g., firmware). In some embodiments, the operations are performed in series, while in other embodiments the operations can be performed in parallel. Furthermore, some embodiments perform only a subset of the operations shown in the figures.

FIG. 2 is a block diagram illustrating text rendering in the wagering game machine of FIG. 1C according to an example embodiment. A first block represents operating system (OS) text 210. This text can be in any language desired. The text must be handled, either by displaying it, printing, sending it out via communication protocols or in other manners as described below. Further text 215 is related to the game being executed by the operating system. Game text may also be handled by many different devices, and may be written in one or more desired languages within the game software. One such device may be a bill validator that deals with currency. A bill validator may be required to deal with cash from different countries and accounting meters.

In one embodiment, the text, such as status messages and graphical user interface component labels is not hard coded into the wagering game software or the operating system. The wagering game software and operating system may use indirect references to messages stored in the text 210 and 215, which together with a language identifier may be used to identify the desired message in the correct language. Locale dependent information, such as dates, number and currencies appear in formats that may conform to a player's regions, jurisdiction and language.

The OS text 210 and game text 215 is provided to a Unicode subsystem 220. While the subsystem is referred to as a Unicode subsystem, in further embodiments, a different character set mechanism may be utilized. In one embodiment, the Unicode subsystem 220 resides within the operating system and is utilized by both the operating system and the game software or theme. The Unicode subsystem 220 is a combination of Unicode based fonts, and the rules for formatting dates, times, currencies, percentages and numbers for any country in the world along with an application programmable interface to access these features. It uses ISO (International Standards Organization) identifiers for language (ISO 639.2 in one embodiment) and country (ISO 3166) to form locales that specify the language and country to be supported.

From a geographic perspective, a locale is a place. From a software perspective, a locale is an ID used to select a set of region or country specific conventions. Locale identification may be specified by at least 3 parameters: country, language, and an optional variant within the country and language. The optional variant may be anything desired, and is not necessarily part of any standard.

Region dependent data, and hence the data that needs to be localized, includes (but is not limited to) the following types of information: messages, colors, dates, currencies, honorifics and personal titles, text on GUI components, graphics, times, measurements, postal addresses, sounds, icons, numbers, phone numbers, and page layouts.

Locale-dependent data may be isolated from the rest of the system. In addition, modification and use of new locale specific data should not require recompilation of the source code.

In one embodiment, the system may support multiple locales simultaneously. One example may be a user selecting a first locale, while an operator or administrator, using remote configuration server 159 may select a different locale for such server or for use directly on a wagering game machine. Still further, a casino operator may select still a different locale.

The use of a ubiquitous character set relieves a game provider from having to create individual releases of a theme and/or operating system that contains fonts and text formatting specific to each country. Ubiquitous is used to mean a character set that has unique characters for each different type of character. One example of such a character set is Unicode. A Unicode standard is a universal character-encoding standard used for representation of text for computer processing and provides a consistent way of encoding multilingual plain text. Character encoding standards define not only the identity of each character and its numeric value, or code point, but also how this value is represented in bits. The one or more sets of fonts correspond to different sets of Unicode characters, each corresponding to a different language. The fonts provide a bit map for each character to be rendered, either on a display screen, for printing, or to be sent to other devices.

The Unicode standard defines three encoding forms that allow the same data to be transmitted in byte, word or double word oriented format (i.e. in 8, 16 or 32 bits per code unit, corresponding to UTF8, UTF16 and UTF32). The use of a double word oriented format greatly increases the number of characters that may be represented, allowing the provision of a unique character set for each supported language. In further or future embodiments, a larger number of words may be used to represent each character.

In one embodiment, multiple countries may now be supported in a single release of game theme/OS, allowing more efficiency in supporting international and domestic markets. Dynamic language selection may also be supported, allowing a player to play in a language of their choosing rather than being limited to a single language that shipped with the machine. The selection may be facilitated by allowing a player to select a language and/or country from a menu. In further embodiments, a player may identify themselves, such as by use of an electronic card or RF tag, or entry of credentials on the wagering game device. The wagering game device may then consult a profile for the player and automatically select an appropriate country and language.

In one embodiment, the OS text 210 and game text 215 may contain several language sets of messages. The Unicode subsystem 220 receives the messages and creates properly formatted messages to one or more servers, such as a bill validator server 225, video server 230, print server 235, protocol server 240 and a generic server 245 for interfacing with various generic peripheral devices. The servers are in turn coupled to actual devices through hardware level.

Bill validator server 225 is coupled to a bill validator 250. The bill validator server 225 is a software module that is responsible for interfacing with bill validator 250. Information from the bill validator 250 is used to determine the country for which the bill validators 250 is accepting bills. The information is then mapped to a locale within the operating system and game, and all currency values are formatted according to the information. The Unicode subsystem 220 uses this information to properly format currencies within cash and accounting meters, including currency symbols, which are included in the Unicode standard.

In one embodiment, video server 230 is coupled to a video/top box display 255. Video server 230 is an operating system module that coordinates display of text either on a video display and/or top box display hardware device. The video server 230 uses the Unicode subsystem to understand Unicode characters that it receives and to properly display them on the video/top box display hardware 255, allowing it to support multiple languages in a single release.

Print server 235 is coupled to a printer 260. In one embodiment, print server 235 is a module within the operating system that uses the Unicode subsystem to be able to receive and understand text that has been formatted using the Unicode subsystem and to create hard copies of things such as event logs, history, vouchers and tickets via a printer. By interfacing the print server 235 with the Unicode subsystem, the game/operating system can send multiple languages to a single printing device without modification or separate release.

In one embodiment, print server 235 comprises a printer driver to accept processing of Unicode characters that are to be sent to the printer 260, which also supports Unicode in an appropriate manner. Since the Unicode character set contains specific mappings of every character in the world, the driver may be written once and used to support ticket printing anywhere in the world with little or no code modifications.

Protocol server 240 is coupled to a protocol port 265. The protocol server 240 actually represents multiple protocols within the system and may include future protocols. Protocols such as SAS allow player/casino-based messages to be sent to the game screen. By combining the protocol servers with the Unicode subsystem, support may be provided for any of these messages in multiple languages in a single release. The protocol port 265 represents the actual hardware port, or portal through which the protocol communication takes place. This could be a serial port, USB, firewire, Ethernet or other type of port, such as common industry standard ports.

Generic server 245 is coupled to a generic peripheral device 270. Generic server 245 provides a generic Unicode interface to various hardware devices, which could include storage devices, personal digital assistants, and may other devices which support a ubiquitous character set, such as Unicode.

In one embodiment, a language choice may be specified by an operator of the game, such as by menu selection from a menu of available languages. It may also be specified by a service technician or other person setting up the wagering game device either at the device or remotely. Still further the technician may select a different language for users of the game, while simultaneously supporting a different language for the technician. This allows languages for messages to be selected for simultaneous use by different entities.

When a language is selected, the selection is provided to the operating system and wagering game software and used to select the language in which messages are provided from the OS text module 210 and game text module 215. The Unicode subsystem 220 in conjunction with the servers provide the Unicode characters to hardware devices, which render the text appropriately. Such hardware devices may need to specifically support Unicode, or may simply take and display bitmaps provided from a server.

Figure 3A:
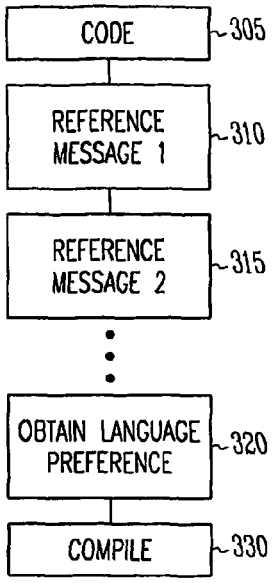
FIG. 3A is a flow chart representation of message identification in code in the wagering game machine of FIG. 1 according to an example embodiment.

FIG. 3A is a flow chart representation of programming that includes messages in the wagering game machine of FIG. 1. Code is represented at block 305, and can be game code or operating system code. At 310, a first message is referred to in the code. It may be related to payout information, game playing information, attract mode information, or any other type of information that may be presented to a user or operator of the wagering game machine. A second message is referred to in the code at 315. A language preference may be obtained at 320, such as by selection from a menu or default if no selection is made. The code may be compiled at 330. In further embodiments, the code may also be interpreted or compiled.

Figure 3B:
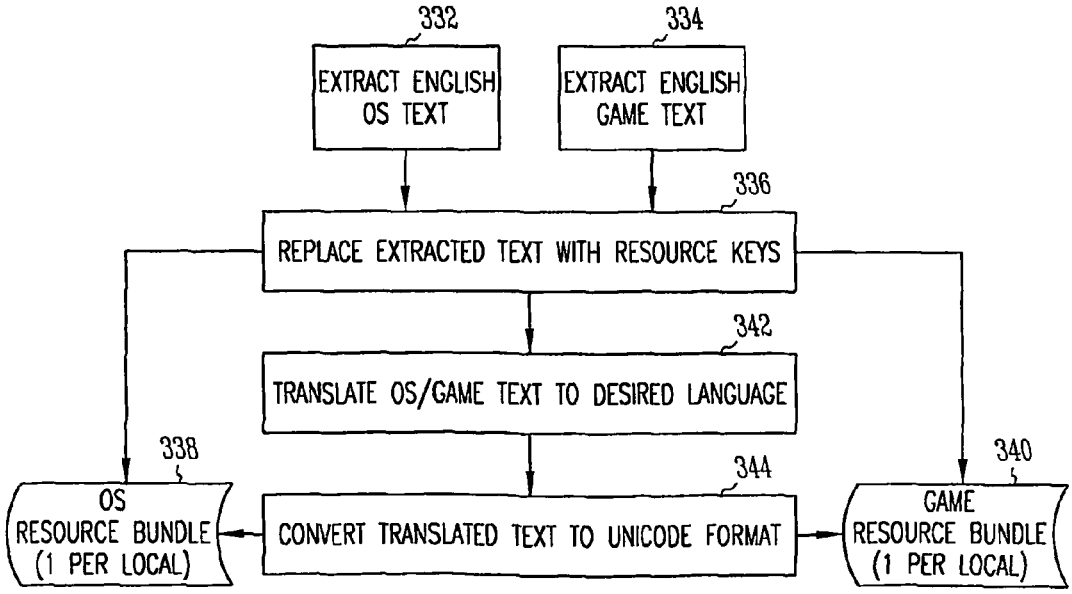
FIG. 3B is a block diagram illustrating a text conversion process for programs according to an example embodiment.

Conversion of existing code is illustrated in FIG. 3B. The existing code in one embodiment has English text throughout the code. The process begins by first identifying all the text strings within the Operating System (OS) and the Game. At 332, the text is extracted from operating system code, and at 334, the text is extracted from wagering game related code. Next, the extracted text for both the OS and Game are mapped to resource keys or message IDs, at 336 which uniquely identify each text string. At this same time, any formatting of the string, including compound strings, pluralization, etc, is included in the mapping. The output of this step will be the default US resource bundles for English. This result is then stored in the OS and Game Resource Bundle files at the bottom of FIG. 3B at 338 and 340.

Once the English OS and Game Text has been extracted and mapped to resource keys, it's then translated into each desired language at 342. The translations are then converted to Unicode at 344 and stored in the locale specific Resource Bundles for both OS and Game as represented by the Resource Bundle boxes 338 and 340. There will be a Resource Bundle file for every language that the English text was translated into. These Resource Bundle files represent 210 and 215 of FIG. 2, OS Text and Game text respectively.

Figures 3C, 4:
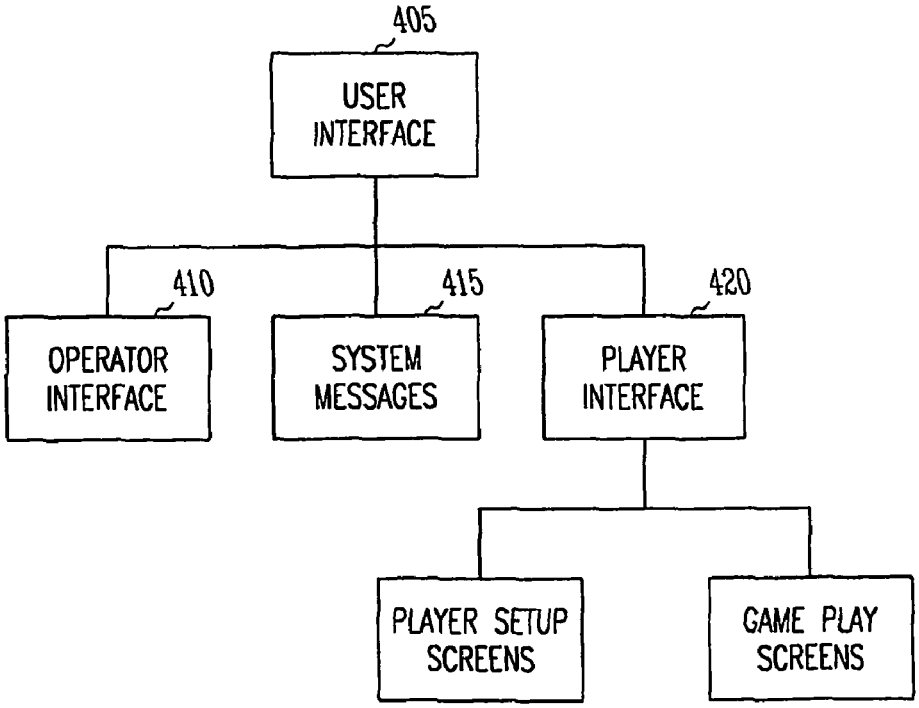
FIG. 3C is a table illustrating messages generated in Unicode characters for different languages according to an example embodiment.
FIG. 4 is a block diagram representation of a user interface organization according to an example embodiment.

The messages referred to in the code at 310 and 315, and other places as represented by the continuation dots between blocks 315 and 320 are referenced by a resource key in one embodiment, which may be a unique address, as opposed to containing the actual message. A table as shown in FIG. 3C at 350 illustrates addressing of messages in the different languages. Each column of messages corresponds to a resource bundle or bundles if a separated into OS and Game bundles. In one embodiment, the resource key points to a message as shown in column 355. The resource key may be a descriptive phrase or code as desired. Resource keys for the first and second messages are shown at 360 and 365 in the resource key column. The messages may use different Unicode character sets for each of several different languages, as indicated at columns 370 for English characters, 375 for French characters and column 380 for Japanese characters. Each of these sets of characters corresponds to a separate uniquely identified character set in Unicode. The text of each of the message need not be literal translation between each different language.

The column containing messages in the user selected language is then used to render messages using fonts corresponding to the different character sets. The Unicode characters in the table corresponding to the message ID are sent to a printer driver or video driver, which then present the message to the user in the desired language.

The use of message IDs or resource keys, and the resource bundles allow messages to be generated in different languages without the need for a translator to understand the code. The messages may simply be put in the right format for each language in the table itself, using the character set for that language. Messages can then be generated in different languages without rebuilding the software system.

The following sections describe various requirements for one example system related to proper display of text using a ubiquitous character set.

Text Messages: Display text messages are to be encoded in Unicode and should not be hard-coded in source code. The display text messages in source files are referenced using locale identifiers.

Compound Messages: Compound messages are textual display elements that contain strings and variables. Compound messages are implemented such that they can be localized without source code changes. Localization of compound messages includes translating the text of the message, changing the order of the text and variable[s] in the message, and changing the format of the text and variables. The example below shows the display of a message that contains text mixed in with 4 variables (i.e., Time, Date, Number of Spaceships, and Planet).

At 1:15 PM on Apr. 13, 1998, we detected 7 spaceships on the planet Mars.

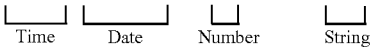

Pluralization: Pluralization is related to compound messages and allows the system to handle text message display changes based upon the number of items to which the text is referring. In one embodiment, the system handles pluralization at run-time and chooses the appropriate form of the text message based upon the value of the relevant variable. In addition, the message variants necessary for handling pluralization may be localizable, again without changing source code. An example below shows typical variations to be expected with pluralization and how the pluralization might vary between a system localized for the USA and France.

USA

There are no files on XDisk.

There is one file on XDisk.

There are 2 files on XDisk.

France

Il n'y a pas des fichiers sur XDisk.

Il y a un fichier sur XDisk.

Il y a 2 fichiers sur XDisk.

Game Translation: A translator creates a version of a game for a new language without having to edit the source code directly. Instead all translatable and locale-specific resources (text, graphics, sounds, animations and fonts) are isolated and dynamically accessible at runtime using an Application Programming Interface (API).

Numbers: Numbers may be formatted based on the locale. The system supports the ability to format the display of numbers at run-time based upon locale information that is isolated from the source code. The display of numbers varies according to usage for the decimal separator, the thousands separator, the symbol to represent the minus sign, the character used for the number 0 and the representation of negative values. The following example shows how the display of a specific number would vary between the US, France, and Germany:

| | |
|---|---|
| 345 987,246 | France |
| 345.987,246 | Germany |
| 345,987.246 | USA |

Currency: Currency values are formatted based on the locale. The system supports the ability to format the display of currency at run-time based upon locale information that is isolated from the source code. The display of currency values varies according to usage for the currency symbol, the decimal separator, the thousands separator, the symbol to represent the minus sign, the character used for the number 0 and the representation of negative values. In one embodiment, the system supports the ISO-4217 standard for global currency codes. The following example shows how the display a specific currency value might vary between the US, France, and Germany:

| | |
|---|---|
| 9 876 543,21 F | France |
| 9.876.543,21 DM | Germany |
| $9,876,543.21 | USA |

The system also is able to convert a currency value to its textual representation. For example, the system converts $10.55 to "Ten dollars and fifty-five cents."

Dates and Times: Display formatting of dates and times may be configurable and may also depend on the locale. The available date and time format styles may depend on the locale. The system supports the ability to format the display of dates and times at run-time based upon locale information as well as the configured style, without recompilation. The following examples show how the display of specific dates and times might vary between the USA, France, and Germany:

| | |
|---|---|
| 20 avr 98 | France |
| 20.4.1998 | Germany |
| 20-Apr-98 | USA |
| 20/04/98 | France |
| Apr. 20, 1998 | USA |
| 3:58:45 PM | USA |
| 15:58:45 | Germany |

Fonts: Fonts may be referenced by the source code through an API and dynamically retrieved based on the selected locale. Fonts are provided to display Unicode encoded characters in one embodiment.

Ticket Printing: In one embodiment, the language, currency and format of the printed tickets may be configurable for several different locales, as resources allow. The operator will typically setup a ticket format for the operator interface locale as well one for each of the player-selectable locales. In addition, the operator may wish to setup ticket formats for additional locales.

User Interface: A user interface is illustrated at 405 in FIG. 4. User interface 405 is divided into an operator interface 410, system messages 415 and player interface 420. Operator interface 405 includes user interface functions that are available to casino and regulatory personnel, generally through one of the secure access methods supported by the system. This includes the RAM Clear interface and Administration interface. Administration of the system may be performed locally, such as directly on the system, or remotely as previously described.

The player interface 420 covers all user interface functions that available to a player and without special access mechanisms. The player interface is further broken down into player setup screens 425 and game play screens 430.

The system messages interface 415 covers all messages that are generated by the system in response to certain events that require notification, through the system display, of either the player or the operations staff.

The system supports the ability for the operator interface 410 to be configured for a different locale than the player interface. System messages 415 defaults to the player interface 420 locale and may not require separate configuration.

Default locale support: The system supports the Default locale for the operator interface and player interface, regardless of what other locales are supported in one embodiment. A different default language/locale may be selected if desired. The default locale is used for the RAM Clear software as well as operational system software. If a specific locale is not supported by the system, the system falls back to the default or other designated default.

Operator selection of player languages (locales) enabled for game play: In one embodiment, the system provides the ability for the Administrator to select the languages available to the player for game play again using a Menu available in the Admin screen. These languages may then be available to the player for selection on the Main Game Screens. There is no limit to the number of languages that an operator can select, other than system resources. Note: The administrator will actually configure the enabled "locales." The locales uniquely determine the language. Player Interface: The system supports real-time player selection of a language from a pool of multiple languages. The system software design does not limit the number of languages that can be simultaneously supported.

Multiple Languages/Player Selectability: The system provides the ability for the player to select the language using a button located on the main game screen. This method of selecting languages may be similar to the selection of denominations by the player. This button may also be located on the Main Menu screen of a multi-game machine. The button may be designed in a language-neutral manner so that a player of any origin and that speaks any language is easily able to switch languages. This language will be used for all player visible screens including Main Game Screens, Help screens, Pay Table screens and Bonus Game screens as well as System messages. The default language may be determined by the operator's configuration.

Currency Display: Denomination graphics, located on a Main Game Screen and Multi-Denomination Selection screens may be displayed without the Currency Symbol. For example, the graphic may read 0.25 and not 25 c. The graphics may however be sensitive to the currency/locale and should format the denomination value accordingly. For example, the denomination graphic for 25 Euro cents must read 0.25 and not, 0.25 in Spain.

The game is capable of displaying a Credit Meter in a locale sensitive manner, with appropriate formatting characters for the thousands separator and decimal separator.

The game is capable of displaying the Cash Meter in a locale sensitive manner, with appropriate formatting characters for the thousands separator, decimal separator and an appropriate currency symbol.

The Cash Meter display is identifiable with a language neutral graphic, such as one displaying bills and coins.

System Messages: The system messages default to the player-selected language. In the event that no translated version of the system message is available in the player-selected language, the system message may be displayed in the operator interface language. In the event that no translated version of the system message is available in the operator interface language, the system message is displayed in American English or other selected default language. System messages from a host protocol (e.g. Host Disable) follow this same convention.

Host System Interfaces: The system interfaces with the host system in the language configured for host system communications. If no language is explicitly configured, the default language for the host system protocol may be used. Likewise, dates, times, numbers and currencies that are reported to the host system may be formatted in the language/locale of the host system protocol.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A wagering game device comprising:

a text module that contains messages in multiple languages, the messages including characters encoded according to a ubiquitous character set, and the messages corresponding to resource keys, each resource key used to access a message type in any of the multiple languages;

a ubiquitous character set subsystem coupled to the text module and containing fonts mapped to the ubiquitous character set, the fonts supporting each of the multiple languages; and a device server coupled to the subsystem for interfacing to a hardware device such that messages are properly rendered on the hardware device in at least one of the multiple languages using any of the fonts, the rendered messages accessed from the text module using the resource keys, wherein characters of the rendered messages are rendered by accessing the fonts using encoding values from the ubiquitous character set.

2. The wagering game device of claim 1 wherein the ubiquitous character set comprises a character set compliant with a Unicode standard.

3. The wagering game device of claim 1 wherein the device server comprises a printer driver for interfacing with a printer, the printer driver accepting processing of the characters in the multiple languages.

4. The wagering game device of claim 1 wherein the text module comprises a game text module that generates messages relating to a game being played with the wagering game device.

5. The wagering game device of claim 1 wherein the text module comprises an operating system text module that generates messages relating to operating system messages.

6. The wagering game device of claim 1 and further comprising a locale resource module providing locale specific graphics and sounds.

7. The wagering game device of claim 1 and further comprising code executing on the wagering game device that references the messages in the text module with a resource key and language selection, and wherein the language selection falls back to a default language if the selection is not available.

8. The wagering game device of claim 7 wherein the subsystem further comprises rules for formatting dates, times, currencies, and numbers for the multiple languages.

9. The wagering game device of claim 7 wherein the subsystem uses ISO identifiers for language and country.

10. The wagering game device of claim 1 wherein the wagering game device enables selection among the multiple languages for rendering messages for simultaneous use by different entities.

11. A method implemented in a wagering game machine, comprising:

providing text to be rendered in one of multiple languages, the text provided from characters of a ubiquitous character set, wherein the ubiquitous character set is used for each of the multiple languages;

selecting language-specific characters from a set of fonts corresponding to the multiple languages using the characters, the set of fonts supporting each of the multiple languages;

providing the language-specific characters in a desired format to a device coupled to the wagering game machine for displaying the text in a desired one of the multiple languages using any of the fonts; and rendering the text on the device, using a device server interfacing to the device, such that the text is properly rendered on the device in the desired one of the multiple languages using any of the fonts, wherein the language-specific characters are rendered by accessing the fonts using encoding values from the ubiquitous character set.

12. The method of claim 11 wherein the characters are specified according to a Unicode standard.

13. The method of claim 11 wherein the language-specific characters are provided to a printer, the printer configured to render the language-specific characters in the desired one of the multiple languages.

14. The method of claim 11 and further comprising applying rules for formatting dates, times, currencies, and numbers for multiple languages.

15. The method of claim 11 and further comprising using ISO identifiers for language and country.

16. The method of claim 11 and further comprising selecting a language from among the multiple languages for text.

17. The method of claim 11 and further comprising defaulting to a default language following a RAM Clear.

18. The method of claim 11 wherein the device is local or remote.

19. A computer readable storage medium having code stored thereon to cause a wagering game machine to implement a method comprising:

providing text to be rendered in the form of a ubiquitous representation of the text in multiple languages, the ubiquitous representation provided using characters of a character set, wherein the character set is used for each of the multiple languages;

selecting language-specific characters from a set of fonts corresponding to the multiple languages using the ubiquitous representation, the set of fonts supporting each of the multiple languages;

providing the characters in a desired format to a device coupled to the wagering game machine for displaying the text in a desired one of the multiple languages using any of the fonts; and rendering the text on the device, using a device server interfacing to the device, such that the text is properly rendered on the device in the desired one of the multiple languages using any of the fonts, wherein the language-specific characters are rendered by accessing the fonts using encoding values from the ubiquitous character set.

20. The computer readable storage medium of claim 19, wherein the ubiquitous representation of the text is provided according to a Unicode standard, and wherein the device comprises a printer, the printer configured to render the characters in the desired one of the multiple languages using the ubiquitous representation.

* * * * *

UNITED STATES PATENT AND TRADEMARK OFFICE

CERTIFICATE OF CORRECTION

PATENT NO. : 8,246,453 B2
APPLICATION NO. : 11/919480
DATED : August 21, 2012
INVENTOR(S) : St. John et al.

It is certified that error appears in the above-identified patent and that said Letters Patent is hereby corrected as shown below:

In the Specifications:

In column 4, line 13, delete “314” and insert --174--, therefor

In column 4, line 64, delete “176” and insert --184--, therefor

In column 7, line 3, delete “validators” and insert --validator--, therefor

In column 7, line 49, delete “may” and insert --many--, therefor

In column 8, line 46, delete “if a” and insert --if,--, therefor

In column 10, line 16, after “display”, insert --of--, therefor

In column 11, line 2, after “that”, insert --are--, therefor

Signed and Sealed this
Eighteenth Day of June, 2013

Teresa Stanek Rea
*Acting Director of the United States Patent and Trademark Office*